US009278825B2

(12) United States Patent
Ishikawa et al.

(10) Patent No.: US 9,278,825 B2
(45) Date of Patent: Mar. 8, 2016

(54) POST-PROCESSING DEVICE

(71) Applicant: FUJI XEROX CO., LTD., Tokyo (JP)

(72) Inventors: Takuya Ishikawa, Kanagawa (JP); Masatoshi Kimura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/219,475

(22) Filed: Mar. 19, 2014

(65) Prior Publication Data

US 2015/0042040 A1 Feb. 12, 2015

(30) Foreign Application Priority Data

Aug. 8, 2013 (JP) ..... 2013-164711

(51) Int. Cl.

| | |
|---|---|
| ***B65H 29/20*** | (2006.01) |
| ***B65H 29/12*** | (2006.01) |
| ***B65H 29/14*** | (2006.01) |
| ***B65H 29/52*** | (2006.01) |
| ***B65H 29/70*** | (2006.01) |
| ***B65H 31/38*** | (2006.01) |
| *B65H 37/04* | (2006.01) |
| *B65H 29/46* | (2006.01) |

(52) U.S. Cl.

CPC ..... *B65H 29/12* (2013.01); *B65H 29/125* (2013.01); *B65H 29/14* (2013.01); *B65H 29/52* (2013.01); *B65H 29/70* (2013.01); *B65H 31/38* (2013.01); *B65H 29/46* (2013.01); *B65H 37/04* (2013.01); *B65H 2301/4212* (2013.01); *B65H 2404/693* (2013.01); *B65H 2701/11232* (2013.01); *B65H 2701/11234* (2013.01); *B65H 2701/1932* (2013.01)

(58) Field of Classification Search

CPC ..... B65H 13/00; B65H 29/46; B65H 37/04
USPC ..... 271/306, 223, 189
See application file for complete search history.

(56) References Cited

U.S. PATENT DOCUMENTS

2011/0222945 A1* 9/2011 Sato ..... 399/408

FOREIGN PATENT DOCUMENTS

JP A-2011-63426 3/2011

* cited by examiner

*Primary Examiner* — Howard Sanders
(74) *Attorney, Agent, or Firm* — Oliff PLC

(57) ABSTRACT

Provided is a post-processing device including a stacking member on which recording materials sequentially transported are stacked, a pair of discharge sections that nips and transports the recording material stacked on the stacking member, an accommodation section in which the recording materials are stacked and accommodated, and a moving member that moves between a contact position where the moving member comes into contact with the recording material stacked on the stacking member and a non-contact position where the moving member does not come into contact with the recording material, wherein when the recording material is transported to the stacking member, the recording material is supported from a rear surface at the contact position.

15 Claims, 6 Drawing Sheets

POST-PROCESSING DEVICE

CROSS-REFERENCE TO RELATED APPLICATIONS

This application is based on and claims priority under 35 USC 119 from Japanese Patent Application No. 2013-164711 filed Aug. 8, 2013.

BACKGROUND

Technical Field

The present invention relates to a post-processing device.

SUMMARY

According to an aspect of the invention, there is provided a post-processing device including:

a stacking member on which recording materials that are sequentially transported are stacked;

a pair of discharge sections that nips and transports the recording material stacked on the stacking member;

an accommodation section in which the recording materials discharged by the discharge sections are stacked and accommodated; and a moving member that moves between a contact position where the moving member comes into contact with the recording material that is stacked on the stacking member and a non-contact position where the moving member does not come into contact with the recording material, wherein when the recording material is transported to the stacking member, the recording material is supported from a rear surface at the contact position.

BRIEF DESCRIPTION OF THE DRAWINGS

Exemplary embodiments of the present invention will be described in detail based on the following figures, wherein.

DETAILED DESCRIPTION

Figure 1:
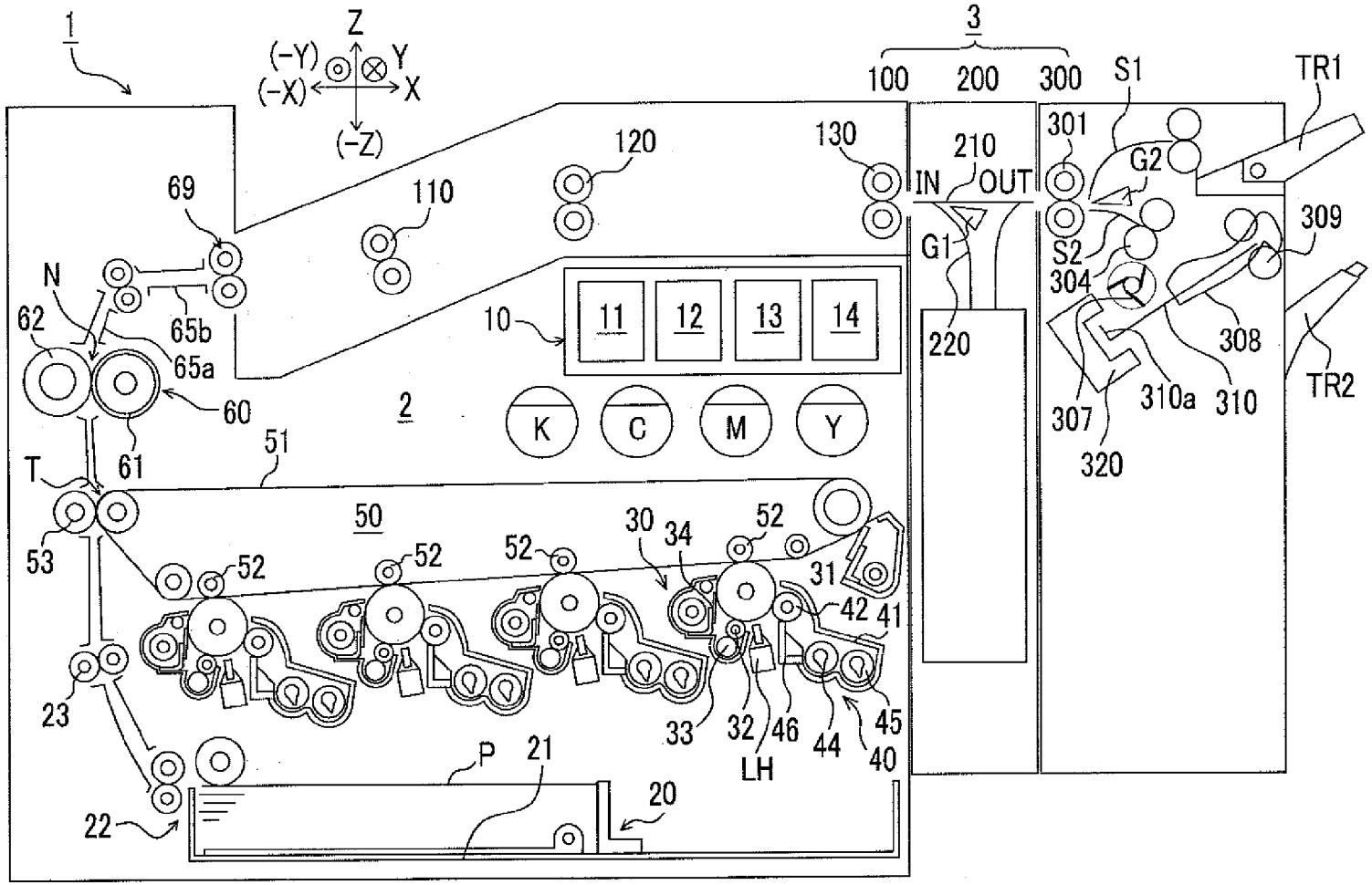
FIG. 1 a cross-sectional schematic diagram showing the internal configuration of an image forming system.

Next, the invention will be described in more detail using an exemplary embodiment and a specific example given below with reference to the drawings. However, the invention is not limited to the exemplary embodiment and the specific example.

Further, in the following description using the drawings, it should be noted that the drawings are schematic and the ratio or the like of each dimension is different from reality, and illustration of members other than those necessary for description is appropriately omitted for ease of understanding.

In addition, in order to facilitate the understanding of the following description, in the drawings, a front-back direction is referred to as an X-axis direction, a left-right direction is referred to as a Y-axis direction, and an up-and-down direction is referred to as a Z-axis direction.

First Exemplary Embodiment

(1) Overall Configuration and Operation of Image Forming System

FIG. 1 is a schematic configurational diagram showing an image forming system 1 to which a post-processing device according to this exemplary embodiment is applied. The image forming system 1 shown in FIG. 1 is provided with an image forming apparatus 2 such as a printer or a copier, which forms an image by an electrophotographic method, and a sheet processing device 3 which performs post-processing on a sheet P with a toner image formed thereon by the image forming apparatus 2. Hereinafter, the overall configuration and operation of the image forming system 1 will be described referring to the drawing.

(1.1) Overall Configuration and Operation of Image Forming Apparatus 2

The image forming apparatus 2 is configured to include a control device 10, a sheet feeding device 20, a photoconductor unit 30, a developing device 40, a transfer device 50, and a fixing device 60. A transport device 100 is placed on the upper surface (in a Z direction) of the image forming apparatus 2, and the sheet P with an image recorded thereon is led to a folding processing device 200.

The control device 10 includes an image forming apparatus control section 11 which controls an operation of the image forming apparatus 2, a controller section 12 which prepares image data according to a print processing request, an exposure control section 13 which controls the lighting of an exposure device LH, a power supply device 14, and the like. The power supply device 14 applies voltage to a charging roller 32, a developing roller 42, a primary image transfer roller 52, a secondary image transfer roller 53, all of which will be described later, and the like and also supplies electric power to the exposure device LH.

The controller section 12 converts print information input from an external information transmission device (for example, a personal computer or the like) into image information for latent image formation and outputs a drive signal to the exposure device LH at a preset timing. The exposure device LH in this exemplary embodiment is configured by an LED head in which a Light Emitting Diode (LED) is placed linearly.

The sheet feeding device 20 is provided at a bottom portion of the image forming apparatus 2. The sheet feeding device 20 is provided with a sheet stacking plate 21, and the sheets P as a large number of recording media are stacked on the upper surface of the sheet stacking plate 21. The sheets P stacked on the sheet stacking plate 21 and determined in position in a width direction by a regulation plate (not shown) are drawn forward (in a −X direction) one by one from the upper side by a sheet drawing section 22 and then are transported to a nip portion of a registration roller pair 23.

The photoconductor units 30 are provided in parallel above (in the Z direction) the sheet feeding device 20, and each photoconductor unit 30 is provided with a photoconductor drum 31 as an image holding member which is rotationally driven. The charging roller 32, the exposure device LH, the developing device 40, the primary image transfer roller 52, and a cleaning blade 34 are arranged along a rotation direction of the photoconductor drum 31. A cleaning roller 33 which cleans the surface of the charging roller 32 is placed to face and be in contact with the charging roller 32.

The developing device 40 includes a developing housing 41 in which a developer is accommodated. The developing roller 42 placed to face the photoconductor drum 31 and a pair of augers 44 and 45 placed diagonally below the back surface side of the developing roller 42 and agitating and carrying the developer to the developing roller 42 side are placed in the developing housing 41. A layer regulating member 46 which regulates the layer thickness of the developer is placed in close proximity to the developing roller 42.

The respective developing devices 40 are configured in approximately the same configuration with the exception of a developer which is accommodated in the developing housing 41, and respectively form a yellow (Y) toner image, a magenta (M) tanner image, a cyan (C) toner image, and a black (K) toner image.

The surface of the photoconductor drum 31 which rotates is electrically charged by the charging roller 32 and an electrostatic latent image is formed thereon by latent image forming light which is emitted from the exposure device LH. The electrostatic latent image formed on the photoconductor drum 31 is developed as a toner image by the developing roller 42.

The transfer device 50 includes an intermediate image transfer belt 51 to which the respective color toner images formed by the photoconductor drums 31 of the respective photoconductor units 30 are multiply transferred, the primary image transfer rollers 52 which sequentially transfer the respective color toner images formed by the respective photoconductor units 30 to the intermediate image transfer belt 51 (primary transfer), and the secondary image transfer roller 53 which collectively transfers the respective color toner images transferred to be superimposed onto the intermediate image transfer belt 51 to the sheet P that is a recoding medium (secondary transfer).

The respective color toner images formed on the photoconductor drums 31 of the respective photoconductor units 30 are sequentially electrostatically transferred onto the intermediate image transfer belt 51 by the primary image transfer rollers 52 applied with a predetermined transfer voltage from the power supply device 14 and the like which is controlled by the image forming apparatus control section 11 (primary transfer), and thus a superimposed toner image in which the respective color toner images are superimposed is formed.

The superimposed toner image on the intermediate image transfer belt 51 is transported to an area (a secondary image transfer portion T) where the secondary image transfer roller 53 is placed, with the movement of the intermediate image transfer belt 51. If the superimposed toner image is transported to the secondary image transfer portion T, the sheet P is supplied from the sheet feeding device 20 to the secondary image transfer portion T in accordance with the timing. Then, a predetermined transfer voltage is applied from the power supply device 14 and the like which are controlled by the image forming apparatus control section 11 to the secondary image transfer roller 53, and the superimposed toner image on the intermediate image transfer belt 51 is collectively transferred to the sheet P which is sent out from the registration roller pair 23 and guided by a transport guide.

Residual toner on the surface of the photoconductor drum 31 is removed by the cleaning blade 34 and collected in a waste developer accommodation section. The surface of the photoconductor drum 31 is re-charged by the charging roller 32. In addition, a residue which is not removed by the cleaning blade 34 and is stuck to the charging roller 32 is trapped and accumulated on the surface of the cleaning roller 33 which rotates in contact with the charging roller 32.

The fixing device 60 includes a fixing roller 61 and a pressure roller 62, and a nip portion N (a fixing area) is formed by a pressure contact area between the fixing roller 61 and the pressure roller 62.

The sheet P with the toner image transferred thereto in the transfer device 50 is transported to the fixing device 60 by way of a transport guide in a state where the toner image is not fixed. The toner image of the sheet P transported to the fixing device 60 is fixed with the action of pressure bonding and heating by the pair of fixing roller 61 and pressure roller 62.

The sheet P with the fixed toner image formed thereon is guided by transport guides 65*a* and 65*b* and discharged from a discharge roller pair 69 to the transport device 100 placed on the upper surface of the image forming apparatus 2.

(1.2) Configuration and Operation of Sheet Processing Device

The sheet processing device 3 is provided with the transport device 100 which transports the sheet P output from the image forming apparatus 2 to the further downstream side, the folding processing device 200 which performs folding processing on the sheet P carried in from the transport device 100, and a post-processing device 300 which includes, for example, a compile tray 310 that collects and bundles the sheets P passed through the folding processing device 200, a stapling mechanism (binding section) 320 which binds end portions of the sheets P, or the like.

The transport device 100 includes an inlet port roller 110 which receives the sheet P that is output through the discharge roller pair 69 of the image forming apparatus 2, a first transport roller 120 which transports the sheet P received by the inlet port roller 110 to the downstream side, and a second transport roller 130 which transports the sheet P toward the folding processing device 200.

The folding processing device 200 is provided with a straight transport path 210 which linearly connects a sheet carry-in port (IN) provided on the downstream side of the second transport roller 130 and a sheet carry-out port (OUT), and a bypass transport path 220 configured to diverge from the midway of the straight transport path 210 and be diverted to the lower side. A folding mechanism which performs various forms of folding such as inward three-folding (C-folding) or outward three-folding (Z-folding) on the sheet P is configured in the bypass transport path 220. Further, a switching gate G1 is provided at a branch portion between the straight transport path 210 and the bypass transport path 220.

The post-processing device 300 is provided with a first post-processing transport path S1 and a second post-processing transport path S2 on the downstream side of a receiving roller 301 which receives the sheet P through the folding processing device 200, and the first post-processing transport path S1 and the second post-processing transport path S2 are made so as to be selected by a post-processing switching gate G2.

The first post-processing transport path S1 is connected to a top tray TR1, and the sheet P on which post-processing is not performed is discharged from the first post-processing transport path S1.

The post-processing device 300 is provided with the compile tray 310 which is provided on the downstream side of the second post-processing transport path S2 and collects and accommodates plural sheets P, and a discharge roller 304 that is a pair of rollers which discharges the sheet P toward the compile tray 310.

Further, the post-processing device 300 is provided with a paddle 307 which rotates so as to push the sheet P toward an end guide 310*b* of the compile tray 310, and a tamper 308 for aligning an end portion of the sheet P.

In addition, the post-processing device 300 includes the stapling mechanism 320 which binds an end portion of a sheet bundle PB accumulated on the compile tray 310, and the bound sheet bundle PB is transported and discharged by an eject roller (a sheet bundle transport roller) 309 as an example of a discharging means.

Then, the post-processing device 300 is provided with a stacker tray TR2 on which the sheet bundles PB discharged by the eject roller 309 are stacked so that a user may easily take them.

(2) Configuration and Operation of Periphery of Compile Tray

Figure 2A:
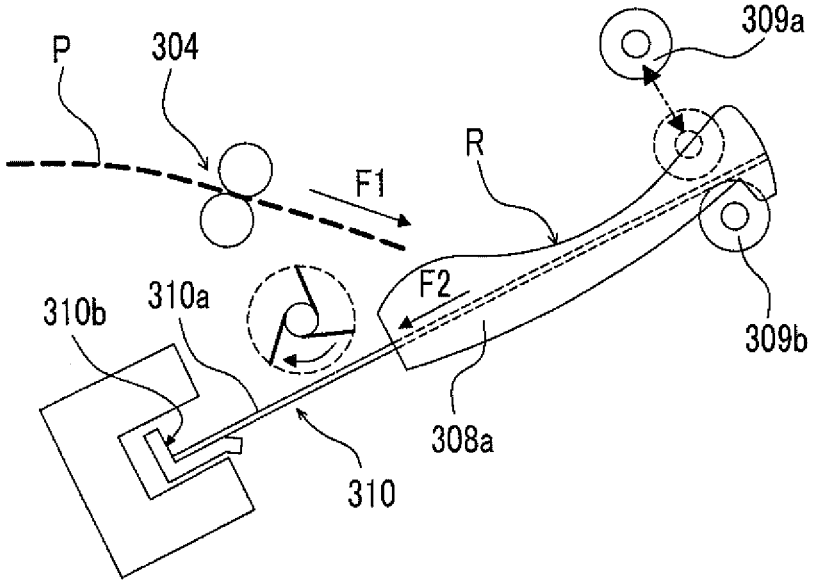
FIG. 2A is a cross-sectional schematic diagram showing the configuration of the periphery of a compile tray.
Figure 2B:
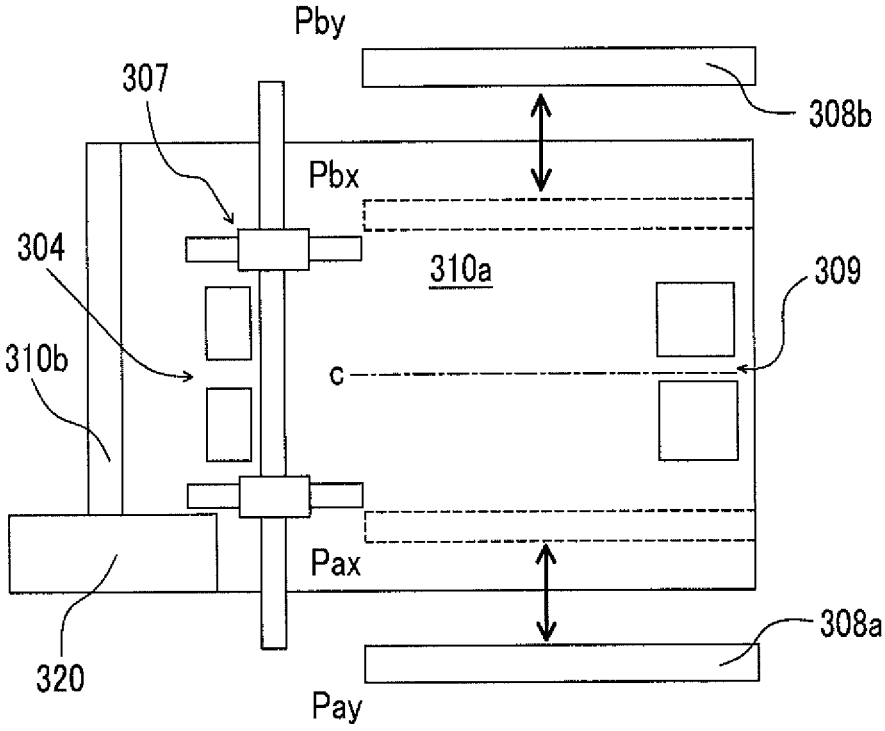
FIG. 2B is a planar schematic diagram.

FIG. 2A is a cross-sectional schematic diagram showing the configuration of the periphery of the compile tray 310, and FIG. 23 is a planar schematic diagram.

The compile tray 310 is provided with a bottom portion 310*a* having an upper surface on which the sheets P are stacked, is obliquely provided such that the sheet P falls along the upper surface of the bottom portion 310*a*, and includes, on one end side thereof, the end guide 310*b* placed so as to align an end portion on the trailing edge side in a traveling direction of the sheet P that falls along the bottom portion 310*a*.

In the compile tray 310, the sheet P is first supplied thereto from the second post-processing transport path S2 through the discharge roller 304 and then falls along the bottom portion 310*a* of the compile tray 310 with the traveling direction reversed. Thereafter, the end portions of the respective sheets P are aligned, whereby the sheet bundle PB is formed. Then, the sheet bundle PB moves up along the bottom portion 310*a* of the compile tray 310 with the traveling direction reversed.

The paddle 307 is provided above the compile tray 310 and on the downstream side in a first traveling direction F1 of the sheet P with respect to the discharge roller 304.

The paddle 307 is configured so as to push the sheet P transported along the first traveling direction F1 (shown in FIG. 2A) on the compile tray 310 in a second traveling direction F2 (shown in FIG. 2A) by rotating the paddle in a direction of an arrow in FIG. 2A.

The tamper 308 includes a first tamper 308*a* and a second tamper 308*b* which face each other with the compile tray 310 interposed therebetween and is configured such that the gap between the first tamper 308*a* and the second tamper 308*b* changes in a direction intersecting the second traveling direction F2 by receiving the driving of a motor (not shown).

Specifically, the first tamper 308*a* and the second tamper 308*b* are placed so as to move between contact positions (Pax and Pbx) where the first tamper 308*a* and the second tamper 308*b* come into contact with the rear surface of the sheet P that is transported on the compile tray 310 and non-contact positions (Pay and Pby) where the first tamper 308*a* and the second tamper 308*b* do not come into contact with the rear surface of the sheet P. In addition, the respective positions Pax, Pay, Pbx, and Pby of the first tamper 308*a* and the second tamper 308*b* in this exemplary embodiment are determined based on a sheet size, a sheet thickness, and a sheet type as the sheet attributes of the sheet P which is supplied to the compile tray 310.

A cross-sectional shape of the upper surface R of each of the first tamper 308*a* and the second tamper 308*b* in the transport direction of the sheet P is formed such that a central portion toward the transport direction of the sheet P has a curved line shape in a direction away from the rear surface of the sheet P. The action thereof will be described later.

The eject roller (the sheet bundle transport roller) 309 includes a first eject roller 309*a* and a second eject roller 309*b*, and the first eject roller 309*a* and the second eject roller 309*b* are placed so as to face each other on the upper side and the lower side with the bottom portion 310*a* of the compile tray 310 interposed therebetween.

The first eject roller 309*a* is provided so as to be able to advance and retreat with respect to the second eject roller 309*b* by receiving the driving of a motor or the like (not shown), on the surface side on which the sheets P are stacked, of the bottom portion 310*a* of the compile tray 310.

The second eject roller 309*b* is placed to be fixed to the rear surface side of the surface on which the sheets P are stacked, of the bottom portion 310*a* of the compile tray 310, and is provided so as to perform only a rotational movement.

Then, in a state where the first eject roller 309*a* comes into contact with the sheet P, the second eject roller 309*b* is rotationally driven, thereby moving up (in a third traveling direction S3) the sheet bundle PB and thus transporting the sheet bundle PB, onto the stacker tray TR2.

(3) Operation and Action of Tamper

Figure 3A:
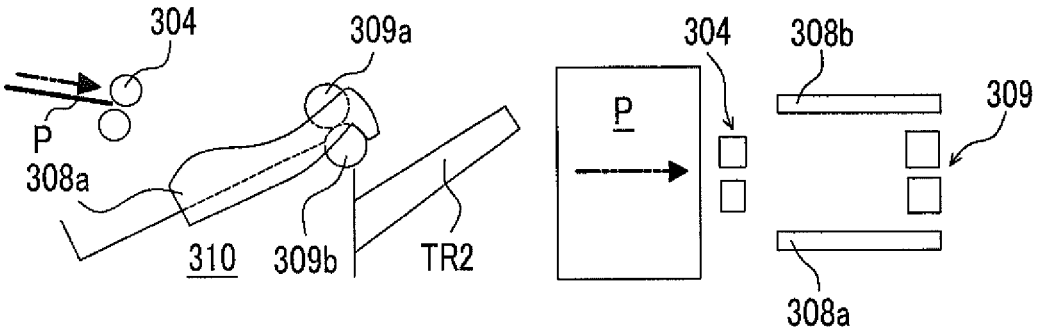
FIGS. 3A to 3C are cross-sectional schematic diagrams and planar schematic diagrams for describing the flow of an operation of a tamper in a post-processing device.
Figure 3B:
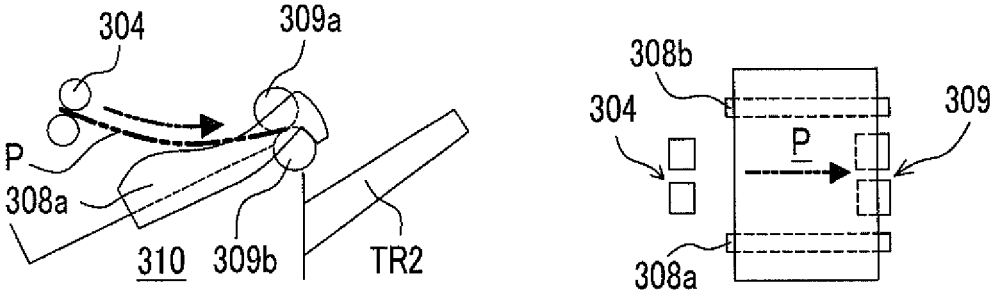
Figure 3C:
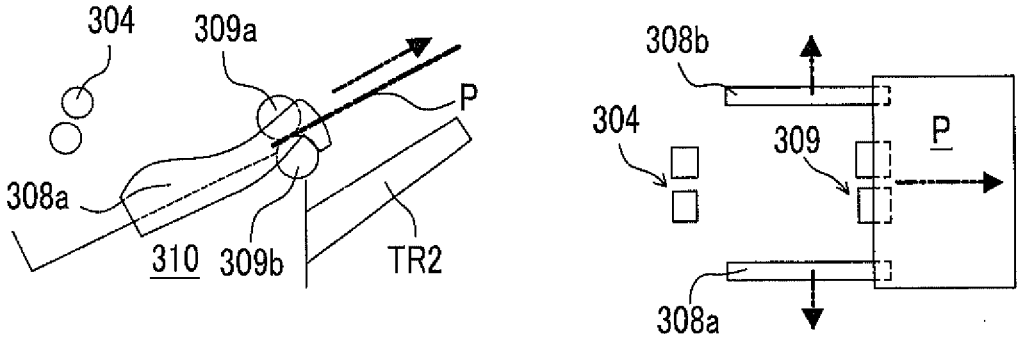
Figure 4:
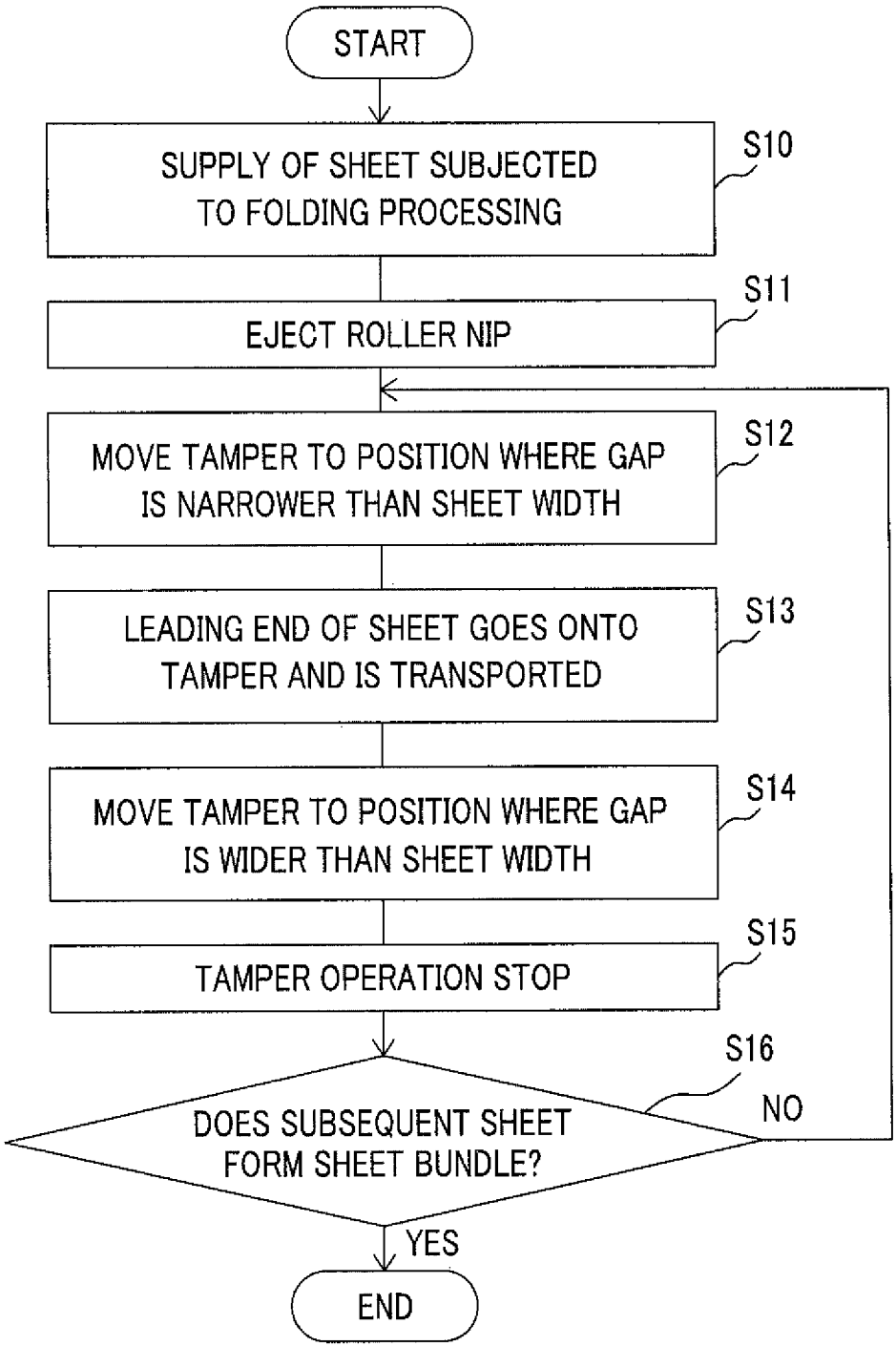
FIG. 4 is a flowchart for describing the flow of an operation of the tamper in the post-processing device.
Figure 5:
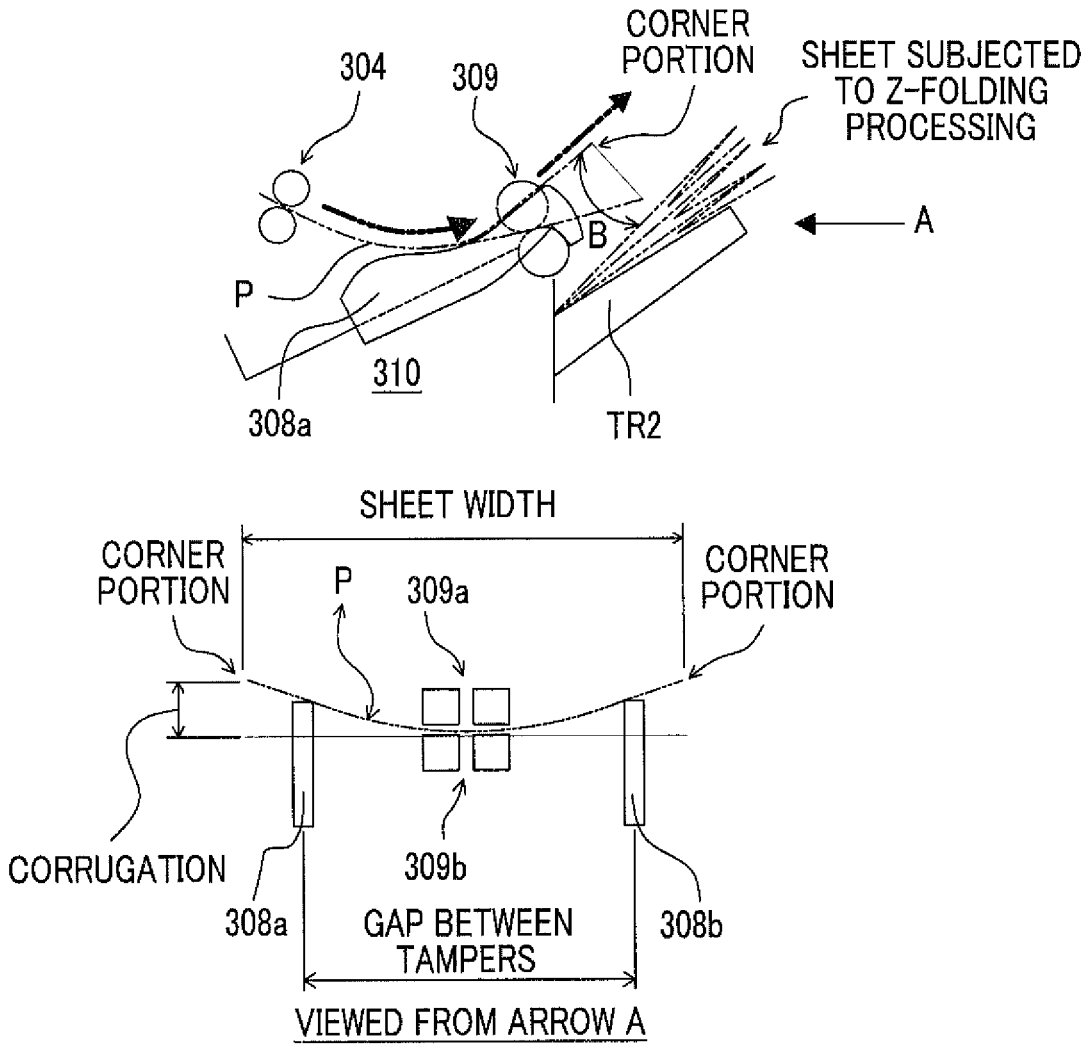
FIG. 5 is a schematic diagram for describing discharge accommodatability of a sheet in the post-processing device.
Figure 6B:
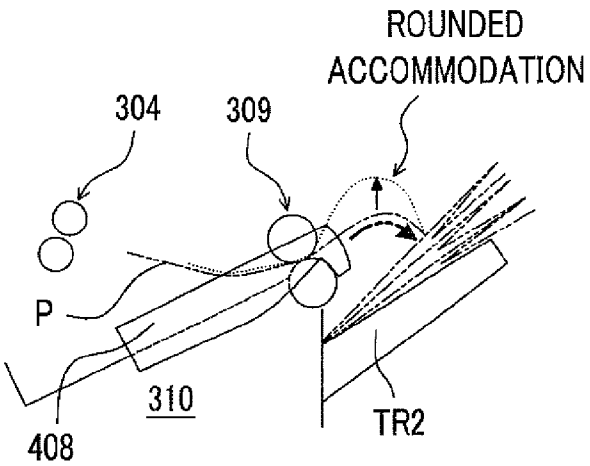
FIGS. 6A and 6B are cross-sectional schematic diagrams for describing discharge accommodatability of the sheet in a post-processing device of a comparative example.
Figure 6A:
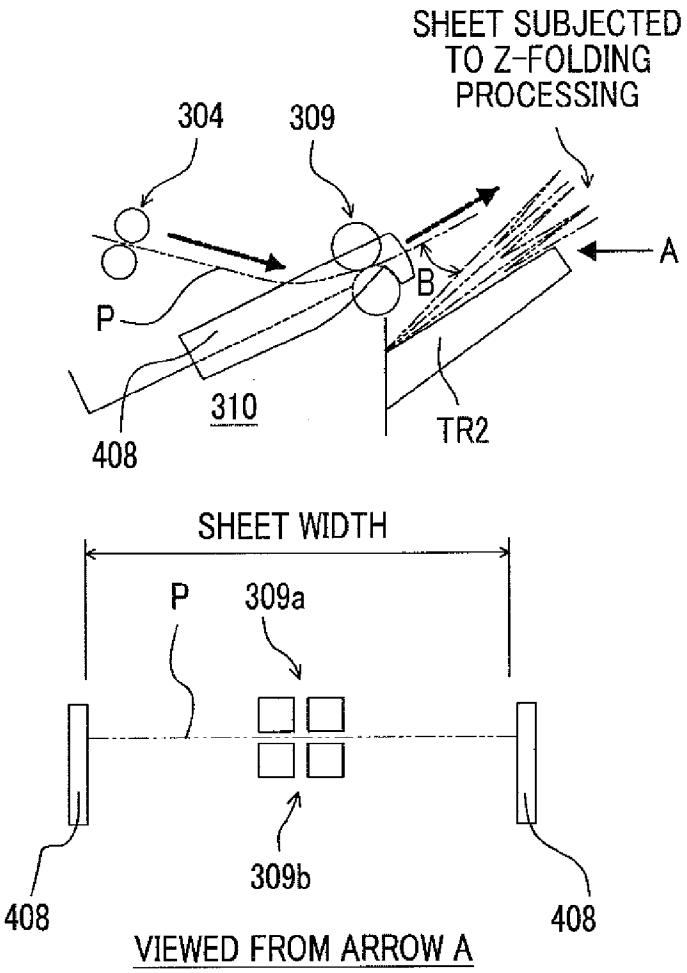

FIGS. 3A to 3C are cross-sectional schematic diagrams and planar schematic diagrams for describing the flow of an operation of the tamper in the post-processing device 300 according to this exemplary embodiment, FIG. 4 is a flowchart for describing the flow of an operation of the tamper in the post-processing device 300, FIG. 5 is a schematic diagram for describing discharge accommodatability of the sheet P in the post-processing device 300, and FIGS. 6A and 6B are cross-sectional schematic diagrams for describing discharge accommodatability of the sheet P in a post-processing device 400 of a comparative example.

Hereinafter, before an operation and action of the post-processing device 300 according to this exemplary embodiment are described, a problem of the discharge accommodatability of the sheet P subjected to Z-folding processing in the post-processing device 400 as a comparative example will be described. In addition, in the following description, a constituent element common to that of this exemplary embodiment is denoted by the same reference numeral and the detailed description thereof is omitted.

(3.1) Operation of Post-processing Device of Comparative Example

The post-processing device 400 according to the comparative example is provided with a tamper 408 for aligning the end portion of the sheet P and is configured so as to align the end portion along the traveling direction of the sheet P which falls along the bottom portion 310*a* of the compile tray 310, as shown in FIGS. 6A and 6B.

In the post-processing device 400, in a case where the sheet P with folding processing such as inward three-folding (C-folding) or outward three-folding (Z-folding) performed thereon in the folding processing device 200 is supplied through the discharge roller 304 and transported to the stacker tray TR2 by the eject roller 309, thereby being stacked on the stacker tray TR2, bulkiness or swelling in an overlap area of the sheet P occurs on the leading end side.

For this reason, an angle of inclination (B in FIG. 6A) of the sheets P stacked on the stacker tray TR2 increases as the number of stacked sheets P increases, and thus there is a case where a leading end portion of the subsequent sheet P collides therewith, thereby easily curling up in a roll shape (refer to FIG. 6B).

If a phenomenon in which the sheet P curls up in a roll shape occurs, there is a concern that it may adversely affect an accommodation state of the sheet P on the stacker tray TR2. As such an adverse effect, for example, the discharged sheets P not overlapping uniformly, the sheet P on the stacker tray TR2 being pushed out from the stacker tray TR2 by the sheet P which is sequentially discharged later, or the like may be given.

(3.2) Operation of Post-Processing Device of this Exemplary Embodiment

The post-processing device 300 according to this exemplary embodiment is provided with the tamper 308 which moves between the contact position where the tamper 308 comes into contact with the rear surface of the sheet P that is transported on the compile tray 310 and the non-contact position where the tamper 308 does not come into contact with the rear surface of the sheet P.

Then, if the sheet P is supplied to the compile tray 310, the tamper 308 moves to the contact position, thereby supporting the sheet P from the rear surface, and transports the sheet P while applying a corrugation thereto by deforming a cross section in the sheet width direction into a concave shape, and when a trailing edge portion of the sheet P passes through the eject roller 309, the tamper 308 moves to the non-contact position, thereby stopping the support of the sheet P.

Hereinafter, an operation and action of the tamper 308 will be described referring to the drawings.

For example, if the sheet P with folding processing such as inward three-folding (C-folding) or outward three-folding (Z-folding) performed thereon in the folding processing device 200 is supplied from the second post-processing transport path 52 to the discharge roller 304 side through the receiving roller 301 (S10), a state is created where the first eject roller 309*a* moves to the contact position with respect to the second eject roller 309*b*, thereby nipping and transporting the sheet P (S11).

Next, the first tamper 308*a* and the second tamper 308*b* receive the driving of a motor (not shown), thereby moving symmetrically with respect to a central axis c to the position (the contact position) of a gap narrower than the sheet width of the sheet P (S12; refer to FIG. 3A).

Thereafter, the sheet P goes onto the first tamper 308*a* and the second tamper 308*b* moved to the contact positions through the discharge roller 304 and is transported to a nip area between the first eject roller 309*a* and the second eject roller 309*b* while being guided by the upper surfaces of the first tamper 308*a* and the second tamper 308*b* (S13; refer to FIG. 3B).

Then, at a timing when a trailing edge of the sheet P comes out of the nip area between the first eject roller 309*a* and the second eject roller 309*b*, the first tamper 308*a* and the second tamper 308*b* receive the driving of a motor (not shown), thereby moving symmetrically with respect to the central axis c to the position (the non-contact position) of a gap wider than the sheet width of the sheet P (S14; refer to FIG. 3C).

The sheet P passed through the eject roller 309 is accommodated on the stacker tray TR2 and the operation of the tamper 308 is stopped (S15).

Then, in a case where the subsequent sheet P which is supplied to the compile tray 310 through the discharge roller 304 does not form the sheet bundle PB (S16; No), the first tamper 308*a* and the second tamper 308*b* receive the driving of a motor (not shown) again, thereby moving symmetrically with respect to the central axis c to the position (the contact position) of a gap narrower than the sheet width of the sheet P (S12).

In addition, in a case where the subsequent sheet forms the sheet bundle PB (S16; Yes), the position of the tamper 308 is maintained at the non-contact position.

(3.3) Action of Post-Processing Device

As shown in FIG. 5, when the sheet P is transported to the nip area between the first eject roller 309*a* and the second eject roller 309*b* while being guided by the upper surfaces of the first tamper 308*a* and the second tamper 308*b* (S13; refer to FIG. 3B), the sheet P is transported in a state where the cross section in the sheet width direction is deformed.

That is, since the upper surfaces of the first tamper 308*a* and the second tamper 308*b* which support the sheet P from the rear surface are formed to further protrude than the nip area between the first eject roller 309*a* and the second eject roller 309*b*, the entire cross section in the sheet width direction of the sheet P is deformed into a concave shape, whereby a sheet stiffness by a so-called corrugation is given (refer to a view from an arrow A in FIG. 5).

For this reason, the sheet P is discharged in a state where straightness is improved, and thus it becomes difficult for the leading end side in a discharge direction of the sheet P to curl up in a roll shape and it is possible to suppress rounded accommodation by reducing a contact angle with the previously accommodated sheet P. In particular, a leading end corner portion of the subsequent sheet P first landing on the previously accommodated sheet P is suppressed, and thus it is possible to prevent sheet accommodation disorder on the stacker tray TR2.

At a timing when the trailing edge of the sheet P comes out of the nip area between the first eject roller 309*a* and the second eject roller 309*b*, the first tamper 308*a* and the second tamper 308*b* move to the position (the non-contact position) of a gap wider than the sheet width of the sheet P, thereby stopping the support of the sheet P which is discharged.

For this reason, frictional resistance between the rear surface of a trailing edge portion of the sheet P and the upper surfaces of the first tamper 308*a* and the second tamper 308*b* is reduced, and thus it is possible to prevent an accommodatability defect in which the trailing edge of the sheet P remains in an outlet port of the second eject roller 309*b*.

Further, the cross-sectional shape in the transport direction of the sheet P of the upper surface R of each of the first tamper 308*a* and the second tamper 308*b* is formed such that the central portion toward the transport direction of the sheet P has a curved line shape in a direction away from the rear surface of the sheet P.

For this reason, it is possible to suppress damage to the sheet due to a collision at the time the leading end portion of the sheet P which is supplied from the discharge roller 304 onto the compile tray 310 rushes to the upper surfaces of the first tamper 308*a* and the second tamper 308*b*.

It is possible to change the gap at the contact position between the first tamper 308*a* and the second tamper 308*b* according to a sheet size, a sheet thickness, and a sheet type as the sheet attributes of the sheet P. For example, with respect to the sheet P having relatively high rigidity as in cardboard or coated paper, the gap is set to be wide, and in the sheet P having relatively low rigidity as in thin paper or plain paper, the gap is set to be narrow, whereby the sheet stiffness by a corrugation is stably given.

As a result, it is possible to prevent sheet accommodation disorder on the stacker tray TR2 regardless of the sheet attributes of the sheet P.

In addition, in the post-processing device 300, in a case where the sheet bundle PB is formed on the compile tray 310, similar to the comparative example, the first tamper 308*a* and the second tamper 308*b* align the end portion along the traveling direction of the sheet P which falls along the upper surface of the bottom portion 310*a*.

Then, with respect to the sheet P with folding processing such as inward three-folding (C-folding) or outward three-folding (Z-folding) performed thereon in the folding processing device 200, the sheet stiffness by a corrugation is given to the entire cross section in the sheet width direction of the sheet P by changing the movement positions of the first tamper 308*a* and the second tamper 308*b*.

For this reason, it is possible to prevent sheet accommodation disorder on the stacker tray TR2 without adding a new component or the like for a corrugation.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing device comprising:

a stacking member on which recording materials that are sequentially transported are stacked;

a pair of discharge sections that nips and transports the recording material stacked on the stacking member;

an accommodation section in which the recording material discharged by the discharge sections is stacked and accommodated; and a moving member that moves between a contact position where the moving member comes into contact with the recording material that is stacked on the stacking member and a non-contact position where the moving member does not come into contact with the recording material, wherein when the recording material is transported to the stacking member, the recording material is supported from a rear surface by the moving member at the contact position, wherein the moving member includes a tamper mechanism provided with a pair of tampers placed to face each other on the stacking member, and line-symmetrically moves to a gap narrower than a recording material width of the recording material with respect to an axis of symmetry parallel to an axis in a transport direction of the recording material before a front end portion of the recording material is transported onto the stacking member, wherein the pair of tampers are provided to move to a non-contact position of and form a gap wider than a width of the recording material, thereby stopping support of the discharged recording material, and wherein upper surface of the moving member is formed to protrude further than a nip area between the pair of discharge sections, so that an entire cross-section of the recording material, in a sheet width direction, is deformed into a concave shape.

2. The post-processing device according to claim 1, wherein when the moving member supports the recording material from the rear surface at the contact position, the discharge sections transport the recording material while deforming a cross section in a width direction of the recording material.

3. The post-processing device according to claim 2, wherein the contact position is determined based on sheet attributes of the recording material.

4. The post-processing device according to claim 3, wherein a cross-sectional shape of the moving member in a transport direction of the recording material is formed such that a central portion toward the transport direction of the recording material has a curved line shape in a direction away from the rear surface of the recording material.

5. The post-processing device according to claim 2, wherein a cross-sectional shape of the moving member in a transport direction of the recording material is formed such that a central portion toward the transport direction of the recording material has a curved line shape in a direction away from the rear surface of the recording material.

6. The post-processing device according to claim 2, wherein the gap is determined based on sheet attributes of the recording material.

7. The post-processing device according to claim 6, wherein a cross-sectional shape of the tamper in a transport direction of the recording material is formed such that a central portion toward the transport direction of the recording material has a curved line shape in a direction away from the rear surface of the recording material.

8. The post-processing device according to claim 2, wherein a cross-sectional shape of the tamper in a transport direction of the recording material is formed such that a central portion toward the transport direction of the recording material has a curved line shape in a direction away from the rear surface of the recording material.

9. The post-processing device according to claim 1, wherein the contact position is determined based on sheet attributes of the recording material.

10. The post-processing device according to claim 9, wherein a cross-sectional shape of the moving member in a transport direction of the recording material is formed such that a central portion toward the transport direction of the recording material has a curved line shape in a direction away from the rear surface of the recording material.

11. The post-processing device according to claim 1, wherein the gap is determined based on sheet attributes of the recording material.

12. The post-processing device according to claim 11, wherein a cross-sectional shape of the tamper in a transport direction of the recording material is formed such that a central portion toward the transport direction of the recording material has a curved line shape in a direction away from the rear surface of the recording material.

13. The post-processing device according to claim 1, wherein a cross-sectional shape of the moving member in a transport direction of the recording material is formed such that a central portion toward the transport direction of the recording material has a curved line shape in a direction away from the rear surface of the recording material.

14. The post-processing device according to claim 1, wherein the recording material is any of cardboard, coated paper, thin paper or plain paper.

15. A post-processing device comprising:

a stacking member on which recording materials that are sequentially transported are stacked;

a pair of discharge sections that nips and transports the recording material stacked on the stacking member;

an accommodation section in which the recording materials discharged by the discharge sections are stacked and accommodated; and a moving member that moves between a contact position where the moving member comes into contact with the recording material that is stacked on the stacking member and a non-contact position where the moving member does not come into contact with the recording material, wherein when the recording material is transported to the stacking member, the recording material is supported from a rear surface by the moving member at the contact position, and when a trailing edge portion of the recording material is discharged from the stacking member to the accommodation section by the discharge sections, support of the recording material is stopped at the non-contact position, wherein the moving member includes a tamper mechanism provided with a pair of tampers placed to face each other on the stacking member, and line-symmetrically moves to a gap narrower than a recording material width of the recording material with respect to an axis of symmetry parallel to an axis in a transport direction of the recording material before a front end portion of the recording material is transported onto the stacking member, wherein the pair of tampers are provided to move to a non-contact position of and form a gap wider than a width of the recording material, thereby stopping support of the discharged recording material, and wherein an upper surface of the moving member is formed to protrude further than a nip area between the pair of discharge sections, so that an entire cross-section of the recording material, in a sheet width direction, is deformed into a concave shape.

* * * * *